United States Patent [19]

Nolan

[11] Patent Number: 4,958,468

[45] Date of Patent: Sep. 25, 1990

[54] COMBINATION SUPPORT AND ATTACHMENT BAR FOR A WINDOW

[75] Inventor: William A. Nolan, Louisville, Ky.

[73] Assignee: United Technologies Automotive, Inc., Dearborn, Mich.

[21] Appl. No.: 860,716

[22] Filed: May 7, 1986

[51] Int. Cl.[5] ..... E06B 1/04

[52] U.S. Cl. ..... 52/204; 52/235; 49/DIG. 2

[58] Field of Search ..... 52/235, 727, 731, 204; 49/DIG. 2

[56] References Cited

U.S. PATENT DOCUMENTS

| | | | |
|---|---|---|---|
| 1,789,970 | 1/1931 | Dreher | 52/204 |
| 3,208,110 | 10/1963 | Griffin | 20/52 |
| 3,964,231 | 6/1976 | Budich et al. | 49/DIG. 2 |
| 4,205,486 | 6/1980 | Guarnacci | 49/501 |
| 4,207,717 | 6/1980 | Hubbard | 52/235 |
| 4,257,202 | 3/1981 | Biro | 52/204 |
| 4,351,131 | 9/1982 | Kubik | 49/501 |
| 4,370,830 | 2/1983 | Schaefer et al. | 49/413 |
| 4,428,156 | 7/1984 | Malm et al. | 49/501 |
| 4,545,161 | 10/1985 | Baumann | 52/235 |

FOREIGN PATENT DOCUMENTS

| | | | |
|---|---|---|---|
| 2143880 | 2/1985 | United Kingdom | 52/204 |
| 2150189 | 6/1985 | United Kingdom | 52/204 |

*Primary Examiner*—David A. Scherbel
*Assistant Examiner*—Creighton Smith

[57] ABSTRACT

A window including a sash assembly having a combination support and screw attachment bar for use with a plastic box-like girder is disclosed. The structural support fits within the plastic girder to provide additional structural rigidity and includes an extension portion adapted to receive a fastening means for providing a secure fastening arrangement for a window latch or other apparatus. The identical structural support may be used in other portions of the window to provide additional structural strength adjacent a lift bar portion for manually manipulating a sash assembly.

10 Claims, 3 Drawing Sheets

COMBINATION SUPPORT AND ATTACHMENT BAR FOR A WINDOW

CROSS-REFERENCE TO RELATED PATENT APPLICATIONS

This application is related to the subject matter disclosed and claimed in Design Application Ser. No. 860,771 for DOUBLE HUNG WINDOW by William A. Nolan, said application filed on even date herewith and assigned to the same assignee.

BACKGROUND OF THE INVENTION

This invention relates to a window assembly including a rigid structural support sized to fit within a portion of the window and acting as an attachment bar. More specifically, the present invention concerns an aluminum extrusion having an extension coacting with a fastener, said extrusion being inserted within a plastic box-like girder for providing additional structural support to the window assembly.

Plastic or rigid vinyl-type windows have been found advantageous for many reasons. Plastic is typically utilized as a construction material for windows because it requires low maintenance and has good heat transfer characteristics in that the thermal transmittance between the space to be conditioned and the ambient is low. Metal windows although capable of requiring low levels of maintenance are not particularly effective at preventing heat transfer Wood windows although effective at preventing heat transfer typically require a high level of maintenance.

In order to effectively utilize plastic windows, it has been found that a box girder construction is particularly suitable. To provide additional structural strength under conditions where necessary, such as in larger-sized windows, reinforcing supports made of a rigid material such as aluminum, may be utilized.

In some plastic windows it has been found necessary to utilize screw attachment bars for providing a firm anchor for screws extending through a plastic member for securing means to lock the window in a closed position. Merely screwing a latch into the plastic provides an opportunity for easy break-in by merely forcing the window and stripping the screw from the plastic. Hence, a metallic bar extending across the plastic member has been used such that significant force is required before the latch can be displaced from the window.

The herein structural support is designed to include an extension portion which serves as a screw attachment bar such that an integral extrusion not only provides structural support, but serves an additional function. This same integral piece may be used in other areas of the window, specifically in those areas where the screw attachment extension serves to provide structural support adjacent a lift bar or handle portion of a sash assembly of the window.

The herein structural support also includes a screw boss for receipt of a fastener extending through a vertical rail into the support. This arrangement acts to dramatically incraese the corner strength of the window and ties the vertical rail to the support.

SUMMARY OF THE INVENTION

It is an object of the present invention to provide an improved window assembly.

It is a further object of the present invention to provide a window assembly wherein plastic girder-type construction is strengthened by the insertion of a structural support within the plastic girder.

It is a still further object of the present invention to provide a screw attachment means for attaching hardware fixedly to the window.

It is yet another object of the present invention to provide a structural support and fastener receiving means for receiving a fastener for providing appropriate strength in securing a latch to a sash assembly.

A still further object of the present invention is to provide a rigid structural support capable of being utilized in multiple locations in a single window and capable of providing additional structural support adjacent the lift handle for raising and lowering the sash assemblies.

Other objects of the present invention will be apparent from the description to follow and the appended claims.

These and other objects of the present invention are achieved according to the preferred embodiment by the provision of a window assembly including a frame. The window assembly further includes a sash assembly mounted for sliding movement within the frame and having the glass portion, a top rail which defines a L-shaped central cavity for receiving the glass portion, and a meeting rail which defines a central cavity for receiving the glass portion and means for a fastener to extend therethrough. Vertical rails for receiving the glass portion which collectively encase the glass portion with the meeting rail and the top rail are further provided. A first rigid L-shaped support is sized to fit within the cavity defined by the meeting rail, said support engaging the meeting rail to form an integrated structural unit and said support including fastener receiving means positioned relative to the meeting rail means for a fastener to extend therethrough such that a fastener may extend through the meeting rail and engage the support.

Also provided is a sash assembly having a combination structural support and screw attachment bar for use with a plastic box-like girder having and an extension portion which may have a fastener extending therethough. Such support includes an aluminum extrusion sized to be located within and to coact with the box-like girder to provide a rigid structural support and having a screw-receiving portion which extends into the girder extension portion, said screw receiving portion being adapted to receive the fastener which may extend through the girder.

DESCRIPTION OF THE PREFERRED EMBODIMENT

The apparatus hereinafter described will be in reference to a double-hung window of a specific structure. It is to be understood that this invention need not apply to a double-hung window per se, and need not apply to the specific structure per se. Other materials may be used than those specifically referenced therefor.

Figure 1:
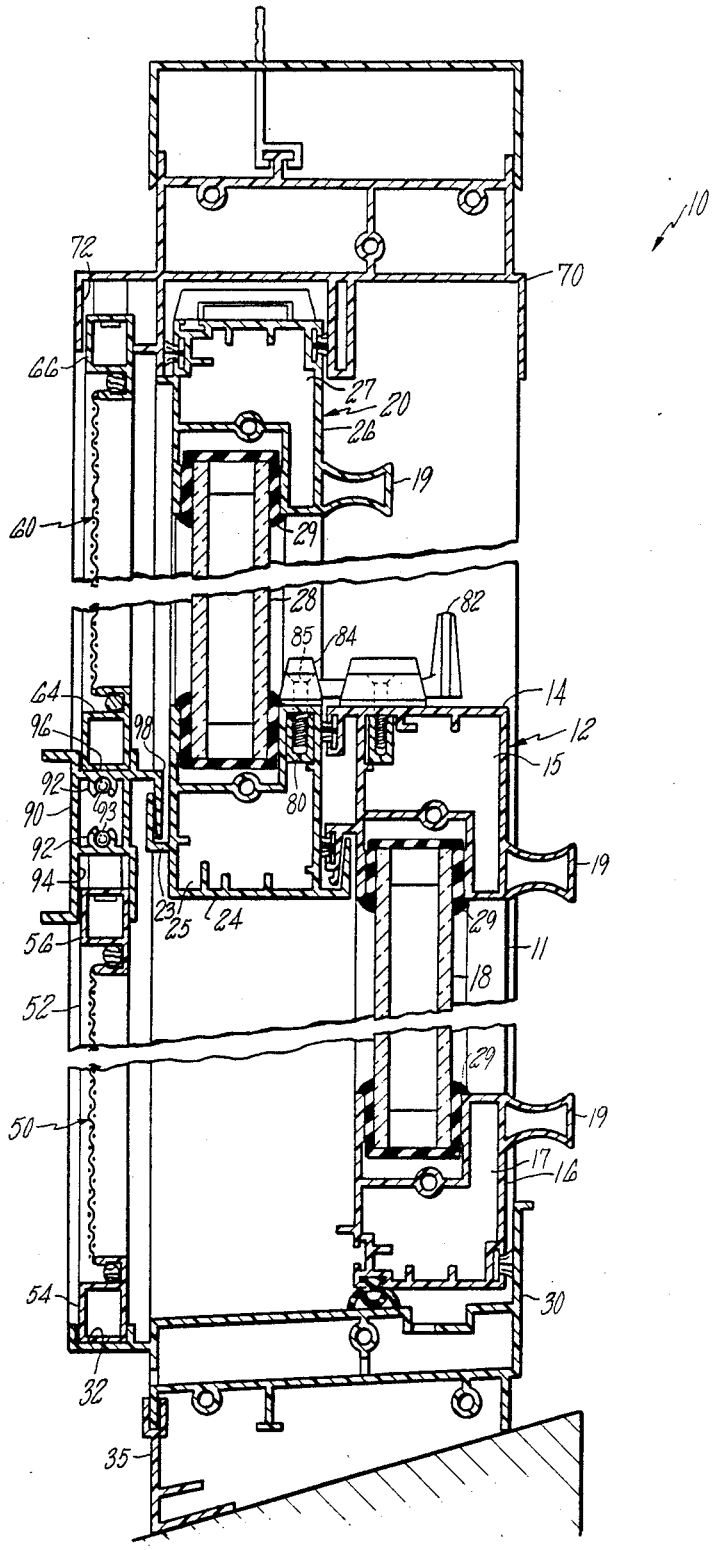
FIG. 1 is a vertical sectional view of the window assembly.

Referring first to FIG. 1, there may be seen a sectional view of a double-hung window assembly 10. This assembly includes top window or sash assembly 20 and bottom window or sash assembly 12, both mounted for vertical displacement within an overall window frame made up of vertical frame jamb supports 40 (see FIG. 2), one located at either end of the window assembly sill 30 and head 70.

The lower sash 12 includes conventional double-paned glass 18 which is secured by glazing channels 29 into lower sash meeting rail 14 and bottom rail 16 as well as vertical rails. Each rail is a box-like extruded vinyl member.

Upper sash 20 includes double-paned glass 28 secured by glazing channels 29 in top rail 26 and top meeting rail 24 as well as vertical rails. Top rail 26 defines a central cavity 27. Upper sash meeting rail 24 defines a central cavity 25. Within central cavity 25 is located screw attachment bar 80 which is a metallic member designed to hold screw 85 which is inserted through lock keeper 84 such that the extending portion from latch 82 may be engaged in lock keeper 84 to lock the sash assemblies in position.

Lower sash meeting rail 14 defines a cavity 15 which also includes a screw attachment bar for securing latch 82 in position. Lower sash lift rail 16 defines a central cavity 17.

Frame sill 30 is mounted to form the bottom portion of the frame of the window and includes an appropriate arrangement to engage sill starter 35 for securing the window assembly in position. Frame head 70 located at the opposite end of the window assembly likewise defines the upper portion of the frame.

Lower sash lift rail 16, lower sash meeting rail 14 and top rail 26 are vinyl-extruded parts and each defines an extending lift bar 19. It is these lift bars which are utilized to raise and the upper and lower sashes.

Looking to the left-hand side of this view, there may be seen stay support bar 90 which is typically an aluminum bar extending across the width of the double hung window assembly. Stay support bar 90 defines screw bosses 92 designed for the receipt of a threaded screw, lower screen slot 94 and upper screen slot 96. Additionally, frame head 70 defines head channel 72 and frame sill 30 defines sill channel 32. Screen or covering member 50 is shown having top horizontal screen rail 56 secured within lower screen slot 94 of the stay bar and lower horizontal screen rail 54 secured within sill channel 32 of sill 30. As can be seen in this view, screen 50 may be displaced upwardly into a vacant portion of lower screen slot 94 such that the lower end of the screen may be swung outwardly from sill channel 32 such that the screen may be removed from this position.

In like manner screen 60 has top horizontal screen rail 66 secured within head channel 72 and lower horizontal screen rail 64 secured within upper screen slot 96 of stay bar 90.

Stay bar 90 additionally defines downwardly-extending angle 98 which is designed to coact with upwardly-extending flange 23 of top meeting rail 24. The interaction of angle 98 and flange 23 acts to provide additional structural integrity to the window assembly.

The window assembly includes additional other elements which are not relevant to the subject matter herein. Many sealing features, gaskets, flexible strips and other arrangements are provided to reduce wind and water leakage through the window. These are not specifically called out in this Figure.

Figure 2:
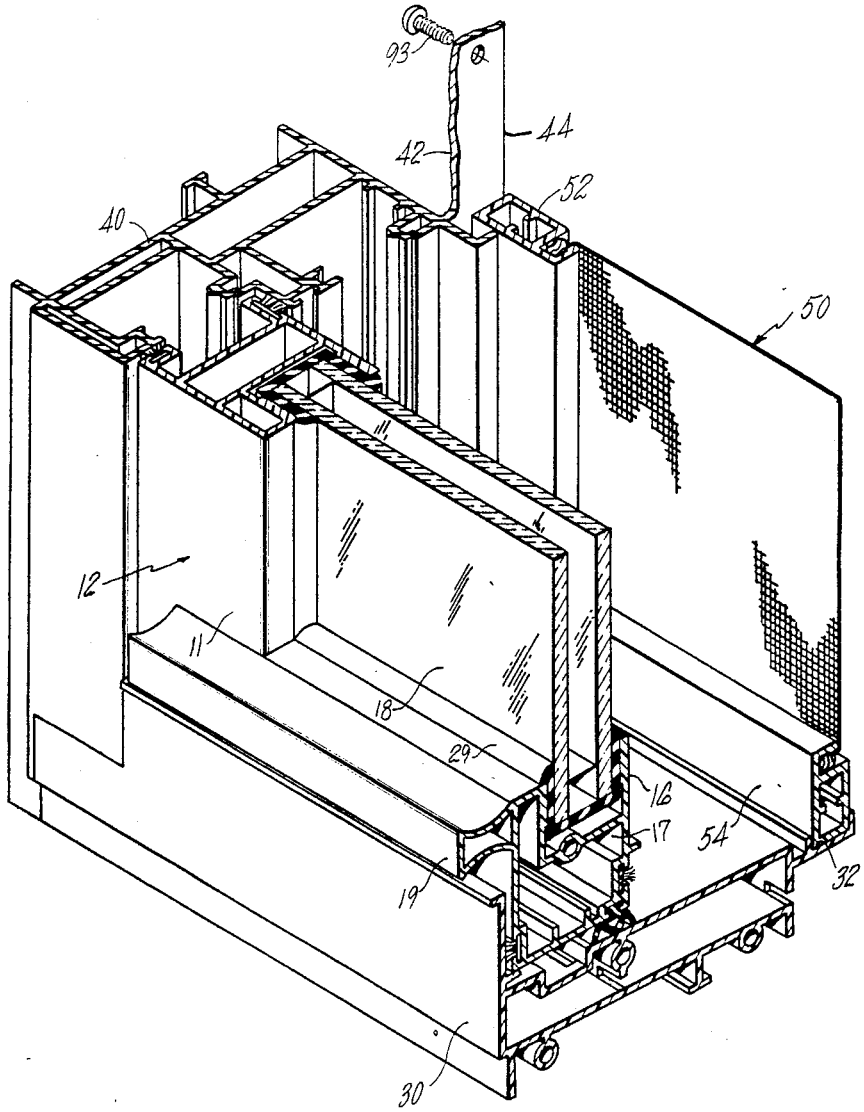
FIG. 2 is a sectionalized perspective view of a portion of assembly as shown in FIG. 1.

FIG. 2 shows a perspective view of a portion of double-hung window assembly 10. In this view it may be see that glass 18 is secured by glazing channel 29 in lower sash lift rail 16. Sill 30, a portion of the lower sash frame, is shown supporting bottom window 12 and defining sill channel 32. The bottom horizontal screen rail 54 of screen 50 is shown mounted within sill channel 32. Extending upwardly from sill 30 is vertical frame jamb support 40, another portion of the window frame. The window is symmetrical, and an appropriate vertical support extends at either end between the sill and the head. Vertical frame jamb support 40 additionally defines an abutment portion 42 and an abutment flange 44. Vertical rail 52 of screen 50 is shown being positioned such that abutment flange 44 prevents further displacement of screen 50 toward bottom window lower sash 12, and abutment portion 42 prevents further displacement of screen 50 toward the vertical support end of the window.

Screw 93 is shown as an exploded portion of this view. When assembled, screw 93 is inserted through abutment flange 44 to engage an interior opening in the stay bar means such as screw bosses 92. In this manner the abutment flange may be rigidly secured to stay bar 90, as shown in FIG. 1, such that the structural integrity of the window frame made up from the two vertical supports, the sill and the head, is enhanced by use of stay bar means.

Additionally, shown in FIG. 2 is lower sash vertical rail 11 which is a rail defining a vertical side of lower sash assembly 12.

Figure 3:
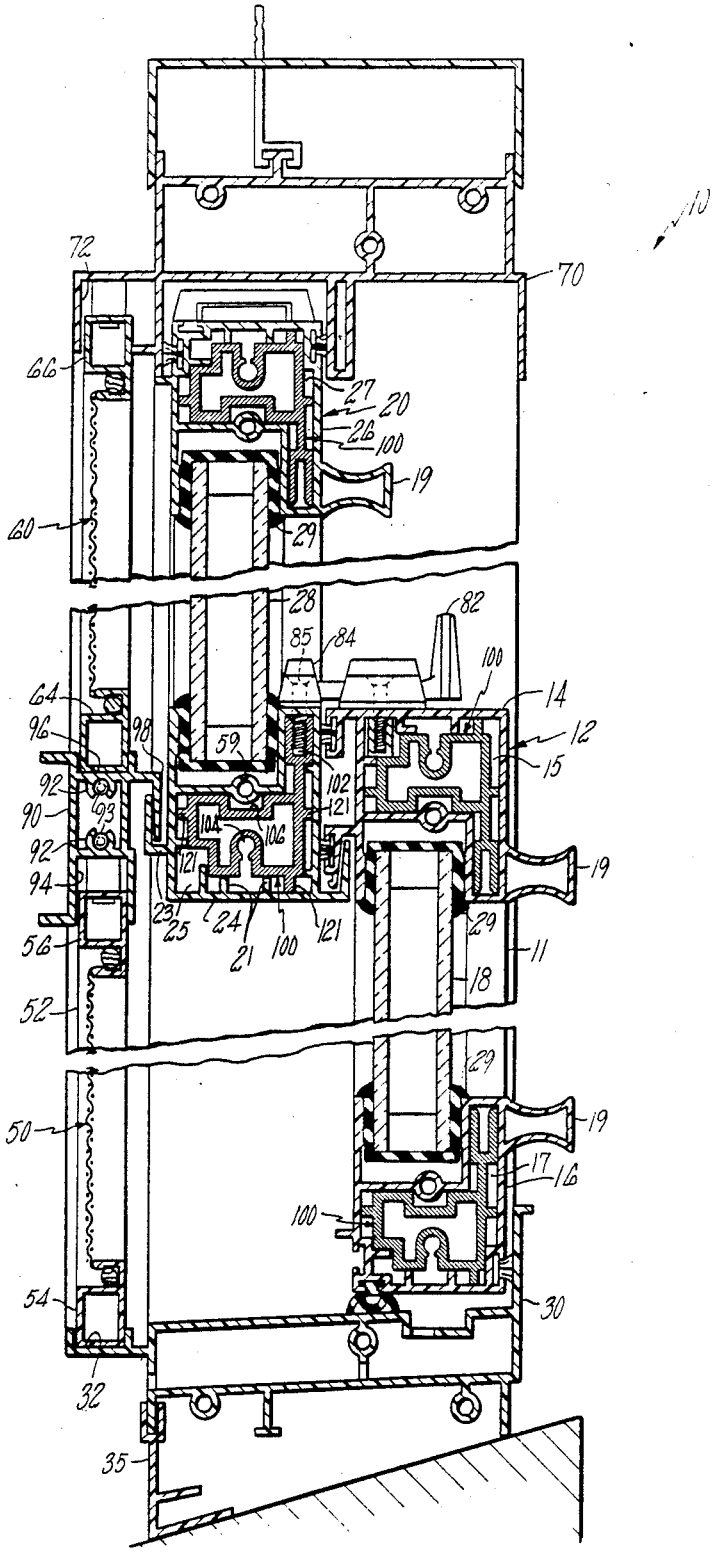
FIG. 3 is a vertical sectional view of the window assembly of FIG. 1 having structural supports inserted within the various cavities defined by the horizontal rail members.

FIG. 3 is an identical view to FIG. 1 with the exception that screw attachment bar 80 has been deleted and support bars or stiffeners 100 have been inserted in cavities 27, 25,., 15 and 17 of top rail, upper sash meeting rail, lower sash meeting rail and lower sash lift rail, respectively.

More specifically, looking at the center of FIG. 3 it may be seen that reinforcement support or stiffener 100 formed as an aluminum extrusion having a box-like encased cross section at the main part, and a screw-receiving portion 102 extending upwardly therefrom, is inserted within cavity 25 defined by upper sash meeting rail 24. This cavity is sized such that with the various meeting rail extensions 21 and support extensions 121, there is a snug fit between the extruded support and the box-like girder. This fit is sufficiently tight that structural rigidity is provided to the rail and consequently to the sash assembly.

Reinforcement 100 has a bypass portion 106 located to bypass screw-receiving boss 59 in upper sash meeting rail 24 and has a screw boss 104 designed such that the single extrusion has an opening for the receipt of a screw for fastening thereto. Additionally, support 100 has a series of extensions labeled 121 collectively to indicate that these support extensions contact the meeting rail and help position the support within the meeting rail to obtain the snug fit as desired. Additionally, the screw-receiving portion extends from the main body of the extruded support and defines a screw-receiving cavity in which screw 85 may be inserted for securing a lock keeper to the support and, hence, to the sash assembly.

Also it may be seen in FIG. 3 that upper sash meeting rail 24 additionally includes meeting wall extensions 21 which extend inwardly from the exterior of the meeting rail and contact the support to additionally help position the support and secure the support relative to the top meeting rail.

It may likewise be seen that the identical reinforcement support 100 fits within cavity 25 of upper sash meeting rail 24, fits within cavity 15 of lower sash meeting rail 14 and likewise cavity 17 of lower sash lift 16, and cavity 27 on top rail 26. In each of these three cavities the screw-receiving portion acts to extend away from the main body of the extrusion to provide support adjacent the lift bar 19 of each rail. Hence, in this manner the body portion of the extrusion is engaged within the primary portion of the meeting rail and the screw-receiving portion extends therefrom to provide additional structural support adjacent the lift bars. The lift bar is that portion of each rail to which most forces will be applied since it is the portion that is manually manipulated to displace the sash assembly.

Although supports 100 are shown within cavities in the top rail and lower sash lift rail, as well as the upper sash meeting rail and the lower sash meeting rail, it is contemplated that in most applications supports 100 will only be utilized within the upper sash meeting rail and the lower sash meeting rail.

The invention has been described with reference to a particular embodiment. It is to be understood by those skilled in the art that variations and modifications can be effected within the spirit and scope of the invention.

I claim:

1. A window assembly including a frame which comprises:

a sash assembly mounted for sliding movement within the frame including:

a glass portion;

a top rail for receiving the glass portion, said top rail defining a central cavity;

a plastic meeting rail for receiving the glass portion, said meeting rail defining a central cavity including an extension portion extending therefrom and including means for a fastener to extend through the meeting rail to the extension portion of the central cavity;

two vertical rails for receiving the glass portion, said rails collectively encasing the glass portion; and a first rigid structural support sized to fit within the cavity defined by the meeting rail, said support engaging the meeting rail to form an integrated structural unit and said support including fastener receiving means positioned to project into the extension portion of the cavity such that a fastener may extend through the meeting rail and engage the fastener receiving means of the support.

2. The apparatus as set forth in claim 1 and further comprising means for securing each vertical rail to the support for increasing the corner strength of the sash assembly.

3. The apparatus as set forth in claim 1 wherein the meeting rail is a box-like plastic member and the support is an aluminum extrusion sized to fit within the meeting rail.

4. The apparatus as set forth in claim 1 wherein the window assembly includes a latch and a fastener to secure the latch to the sash assembly and which comprises:

said meeting rail having an extending portion to which the latch is to be secured; and said support having an extending screw receiving portion sized to fit within the extending portion of the meeting rail and sized to receive the fastener used to secure the latch to the meeting rail.

5. The apparatus as set forth in claim 1 wherein the cavity defined by the top rail is of like dimension to the cavity defined by the meeting rail and further comprising:

a second structural support of identical cross section to the first support, said second support being secured within the cavity defined by the top rail and including an extending screw receiving portion and wherein the top rail defines an extension portion, wherein a lift bar extends from the top rail extension portion and wherein the extending screw receiving portion of the second support extends into the top rail extension portion adjacent the lift bar to give support to the top rail.

6. The apparatus as set forth in claim 4 wherein the window assembly includes additional sash assemblies each having a pair of rails defining cavities of like dimension to the meeting rail cavity and further including additional supports located within said cavities, said supports being of identical cross section to the first support.

7. A sash assembly having a combination structural support and screw attachment bar for use with a plastic box-like girder which defines an L-shaped cavity having a central cavity, an extension portion and which may have a fastener extending therethrough to the extension portion which comprises:

a generally L-shaped aluminum extrusion sized to be located within and to coact with said box-like girder to provide a rigid structural support and having a screw-receiving portion which extends into the girder extension portion, said screw-receiving portion being adapted to receive a fastener which may extend through the girder.

8. The apparatus as set forth in claim 7 wherein the girder includes a screw boss, wherein the extrusion includes a bypass portion and a screw boss portion, said bypass portion extending around the girder screw boss and said screw boss portion defining an opening for the receipt of a fastener.

9. The apparatus as set forth in claim 7 wherein the girder defines girder extensions extending inwardly to coact with the extrusion and the extrusion defines extrusion extensions extending outwardly to coact with the girder.

10. The apparatus as set forth in claim 8 wherein a portion of the extrusion has a box-like cross section and the screw-receiving portion extends therefrom.

* * * * *